US008421583B2

(12) United States Patent
Koyama

(10) Patent No.: US 8,421,583 B2
(45) Date of Patent: Apr. 16, 2013

(54) PTC DEVICE

(75) Inventor: Hiroyuki Koyama, Chiba (JP)

(73) Assignee: Tyco Electronics Japan G.K., Kawasaki (JP)

( * ) Notice: Subject to any disclaimer, the term of this patent is extended or adjusted under 35 U.S.C. 154(b) by 144 days.

(21) Appl. No.: 12/996,620

(22) PCT Filed: Jun. 5, 2009

(86) PCT No.: PCT/JP2009/060347

§ 371 (c)(1), (2), (4) Date: Mar. 7, 2011

(87) PCT Pub. No.: WO2009/148152

PCT Pub. Date: Dec. 10, 2009

(65) Prior Publication Data

US 2011/0170221 A1 Jul. 14, 2011

(30) Foreign Application Priority Data

Jun. 6, 2008 (JP) ..... 2008-148888

(51) Int. Cl.
*H01C 7/10* (2006.01)

(52) U.S. Cl.
USPC ..... 338/22 R; 338/13; 338/223

(58) Field of Classification Search ..... 338/7, 13, 338/22 R, 223, 232, 234, 237, 243
See application file for complete search history.

(56) References Cited

U.S. PATENT DOCUMENTS

| | | | | |
|---|---|---|---|---|
| 3,955,170 | A * | 5/1976 | Geishecker | 338/22 SD |
| 4,222,024 | A * | 9/1980 | Ekowicki | 338/22 R |
| 4,395,623 | A * | 7/1983 | Shimada et al. | 219/544 |
| 5,990,779 | A * | 11/1999 | Katsuki et al. | 338/232 |
| 6,114,942 | A | 9/2000 | Kitamoto et al. | |
| 7,038,896 | B2 * | 5/2006 | Sullivan et al. | 361/25 |
| 8,004,385 | B2 * | 8/2011 | Kahr | 338/22 R |

FOREIGN PATENT DOCUMENTS

| | | | |
|---|---|---|---|
| JP | 3-274706 | A | 12/1991 |
| JP | 6-41231 | U | 5/1994 |
| JP | 2000-188208 | A | 7/2000 |
| JP | 2001-230103 | A | 8/2001 |
| JP | 2003-317592 | A | 11/2003 |
| WO | WO-97/06538 | A1 | 2/1997 |

OTHER PUBLICATIONS

International Search Report for International Application No. PCT/JP2009/060347 (in English).

Written Opinion for International Application No. PCT/JP2009/060347 (in English).

* cited by examiner

*Primary Examiner* — Kyung Lee

(57) ABSTRACT

There is provided a PTC device wherein its PTC element functions appropriately even when the PTC device is used in an environment in which solvent is present. The PTC device includes: (1) a polymer PTC component including a polymer PTC element and a first and a second metal electrodes disposed on both sides of the main surface thereof; (2) a lead connected to at least one of the metal electrodes of the polymer PTC component; and (3) a ceramic package having an open-ended space for accommodating the polymer PTC component, said open-ended space having at least one opening that defines the open-ended space. The lead closes said opening in order to isolate the polymer PTC component disposed in said open-ended space from the environment surrounding the ceramic package.

15 Claims, 4 Drawing Sheets

PTC DEVICE

FIELD OF THE INVENTION

The present invention relates to a PTC (Positive Temperature Coefficient) device comprising a PTC component, in particular a PTC device comprising a PTC component that is used as a circuit protection device, as well as an electrical or electronic apparatus comprising such a device.

BACKGROUND OF THE INVENTION

Polymer PTC components are widely used in various electrical or electronic apparatuses to prevent important elements composing the apparatus from breaking down if an excessively large amount of current flows in the power circuit, etc. Such a component itself is well known, and commonly comprises a PTC element normally in laminar form and composed of a polymer composition of conductive fillers dispersed in a polymer, and metal electrodes, e.g. metal foil electrodes, disposed on the facing main surfaces thereof.

For example, PTC devices having PTC components as described above and a lead or leads connected thereto are used in rechargeable battery packs. A battery pack has a cathode terminal at one end, and the PTC component is electrically connected to the cathode terminal via a lead.

One of requirements that a PTC component used as described above should meet is that the resistance of the PTC component itself be small at normal times. In the PTC element used in such low-resistance PTC component, metal fillers, in particular nickel or nickel alloy fillers are used as conductive fillers to be dispersed in the polymer. Such metal fillers are easily oxidized by oxygen present in the ambient atmosphere of the PTC component, as a result of which the resistance of the PTC element increases. Such increase in resistance is not desirable in a PTC component that should essentially be low resistance.

Therefore, in a polymer PTC component using such metal fillers, the measure of forming a resin coating that covers at least an exposed part is adopted in order that the exposed part of the PTC element does not come in contact with the ambient atmosphere and thus preventing oxidation of the metal filler. Since main surfaces of the PTC element are covered with metal electrodes as described above, such exposed part is mainly a side surface portion of the PTC element (that is, a side portion of a peripheral portion which defines a thickness of the planar PTC element, and therefore a surface which connects peripheral portions of opposing main surfaces of the PTC element).

Such a resin coating is basically effective in preventing the oxidation of the metal filler, but in some cases may not be sufficient depending on the environment in which the PTC device comprising the PTC component is used. For example, if the PTC component is located in an environment around which solvent is present, the resin coating may be degraded by the solvent, as a result of which it may partly break down so that oxygen may access the PTC element. In this case, the metal filler may oxidize, as a result of which the PTC component may be likely not to function appropriately.

A PTC device is shown in International Publication No. WO 1997/06538.

Therefore, it is a problem to be solved is to provide a PTC device wherein the PTC element will function appropriately even when the PTC device is used in an environment in which a substance such as a solvent is present which may affect the PTC device.

BRIEF SUMMARY OF THE INVENTION

As a result of the inventor's study as to the above problem, it has been found that by encapsulating a PTC component in a ceramic package generally used in a semiconductor device and the like, the oxidation of the metal filler contained in the PTC element can be effectively prevented even when the environment in which the PTC device is used contains a substance such as a solvent, as a result of which the resistance of the PTC component can be maintained low.

Therefore, the present invention provides a PTC device comprising (1) a polymer PTC component comprising a polymer PTC element and a first and a second metal electrodes disposed on main surfaces of both sides thereof respectively;

(2) a lead connected to at least one of the metal electrodes of the polymer PTC component; and (3) a ceramic package having an open-ended space for accommodating the polymer PTC component, said open-ended space having at least one opening that defines the open-ended space, the PTC device being characterized by said lead which closes said opening in order to isolate the polymer PTC component disposed in said open-ended space from an environment which surrounds the ceramic package.

In the PTC device according to the present invention, the PTC component is substantially encapsulated in the ceramic package by closing said opening by means of said lead. Such ceramic package is made of a material so-called ceramics. Such material is generally known to have a solvent resistance. As such ceramics, for example, oxides, carbide, nitride, boride and the like of a metal (such as aluminum, silicon, titan, zirconium, zinc and the like) can be exemplified.

Further, the present invention also provides a process for the production in of such a device and an electrical or electronic apparatus comprising such a PTC device.

In the PTC device of the present invention, the ceramics constituting the ceramic package have solvent resistance, so that the oxidation of the metal filler which constitutes the PTC element by air or oxygen present in the ambient environment of the PTC device is effectively prevented when the PTC component is encapsulated within the ceramic package, even if the environment in which the PTC device is used contains a solvent, because the encapsulated state is substantially unaffected. Therefore, there is no need to provide a resin coating as described above around the PTC component. As a result, there is no need to take into account, when forming the resin coating, any outflow of a coating material for the formation of the resin coating on the PTC component onto an electrode surface of the PTC component for forming the resin coating on the PTC component (outflow of coating material onto a place of the component (such as a metal electrode surface) which requires electrical conduction may not allow the electrical conduction that the component requires to be secured). Therefore, design constraints for the PTC device or the PTC component are alleviated and the yield of the PTC device or the PTC component is improved.

Also, whereas the resin coating is not necessarily sufficient in its dimensional precision, the PTC device according to the present invention uses a ceramic package having a standard size, which substantially secure the device size, so that the dimensional precision of the PTC device is improved. As a result, the setting is facilitated when a user incorporates the PTC device in an electrical apparatus and the like. Further, since the ceramic material constituting the ceramic package is stable against an electrolyte in a battery (for example a secondary battery), the PTC device of the present invention may be incorporated inside the battery. As a result, the PTC device may be placed close to the heat source, improving the sensitivity of the PTC device to detect an abnormal condition and the reliability of the battery is improved.

DETAILED DESCRIPTION OF THE INVENTION

Figure 1:
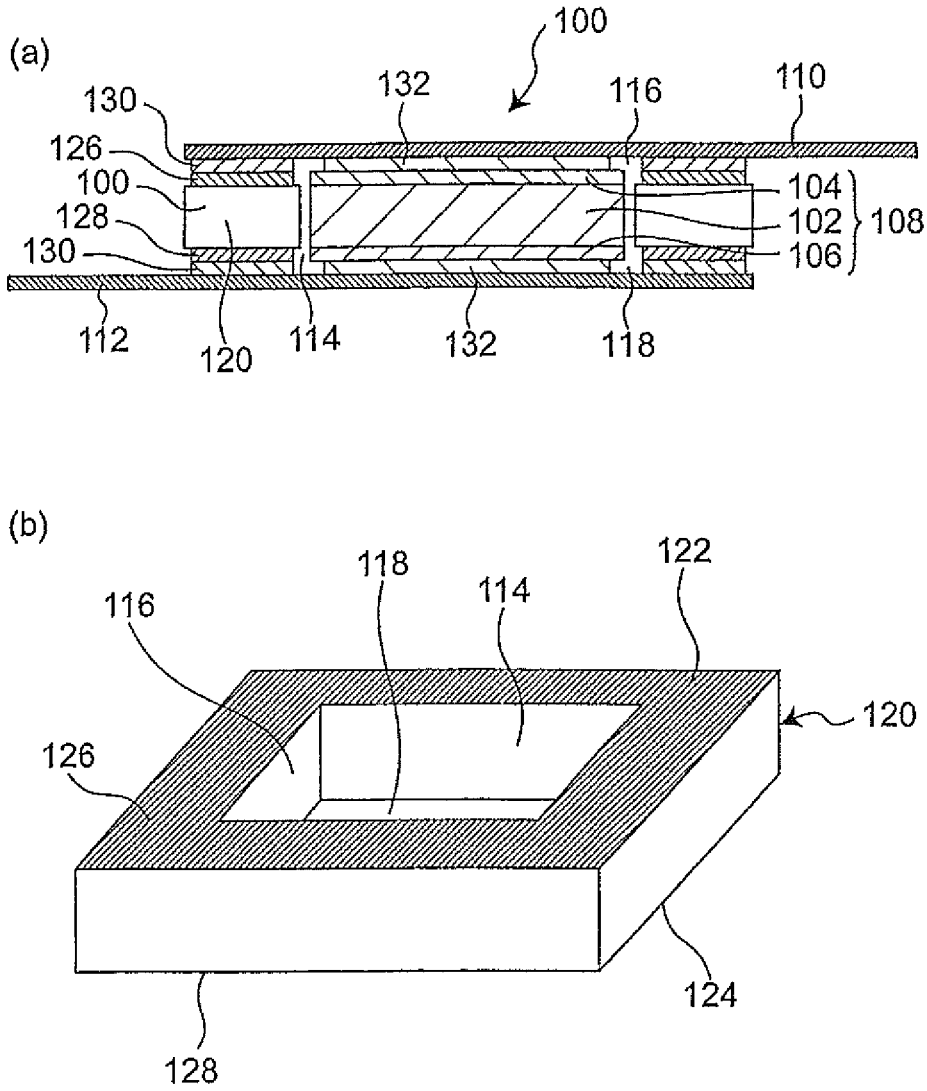
FIG. 1 (*a*) shows schematically a cross-sectional side view of the PTC device of the present invention, and FIG. 1 (*b*) shows schematically a perspective view the ceramic package used in the PTC device of FIG. 1 (*a*)

The PTC component itself contained in the PTC device of the present invention is well known, and the PTC element and the metal electrodes constituting the same are also well known. The term PTC component is used in the meaning of the term generally used in the art, and the PTC component comprises a PTC element of a so-called polymer PTC composition formed into a laminar form (i.e. a polymer PTC element) and a first metal electrode (in particular a foil electrode) and a second metal electrode (in particular a foil electrode) disposed on main surfaces thereof respectively. Further, the polymer PTC element is constituted from a so-called conductive polymer composition of a polymer material (for example polyethylene, polyvinylidene fluoride, etc.) with a metal filler (filler of copper, nickel, a nickel-cobalt alloy, etc.) dispersed therein. Normally, the PTC element may be obtained by extrusion molding such a composition.

The PTC component normally has laminated metal electrodes (normally metal foil electrodes) on the entire main surface of each of the two sides of a laminar PTC element, and is an element that is as a whole also in a laminar or disk form. The PTC component (normally, since the size of the component is small, an aggregate of PTC components) is formed by thermally compressing the metal electrodes on the PTC element, or by simultaneously supplying the metal electrodes when extrusion molding the PTC element or thermally compressing immediately after extrusion molding. The PTC element may be for example in a disk form or a thin strip form.

The ceramic package used in the PTC component of the present invention has a space that can substantially accommodate the PTC component. Normally, the ceramic package as a whole is in the form of a box that can accommodate the PTC component therein and is thus a housing. This space has at least one opening for inserting the PTC component therein. Thus, the space is open-ended at the opening. In other words, the space is an open-ended space.

There is at least one opening defining this open-ended space, and there may be two in another embodiment. In the former embodiment, the ceramic package is opened at one main surface thereof and the ceramic package itself is a housing having a bottom. In the latter embodiment, the ceramic package is opened on the pair of facing main surfaces, and thus the ceramic package has a feed-through space.

Ceramic packages are used to protect microdevices such as semiconductor chips, crystal oscillators, and the like from their ambient environment, and one similar to such ceramic packages may be used in the device of the present invention. The ceramic package may be formed of any appropriated material, for example it may be formed of aluminum oxide ($Al_2O_3$), mullite ($3Al_2O_3.2Si_2$), aluminum nitride (AlN), and the like.

Because in the device of the present invention, the PTC component is encapsulated within the space such that the PTC component is positioned within the ceramic package, the opening is closed by the lead connected to the PTC device. This lead is present in order to electrically connect the PTC component to a predetermined circuit, more specifically to wiring, parts, pads, lands, terminals, and the like, in the electrical apparatus which uses the PTC device, and may be of any appropriate form as long as it can close the opening. For example, the form may be a strip such as a metal foil, a metal sheet, and the like in the form of a square or a rectangle, and the material constituting it may be any conductive material. For example, it may be nickel, Kovar, 42 alloy (Fe-42% Ni alloy), and the like.

The above described lead may be bonded to the ceramic package in any appropriate manner such that the opening of the ceramic package is closed. For example, the lead and the ceramic package may be bonded by means of a connecting material (such as a solder, an electrically conductive adhesive, an electrically conductive paste or the like) as described below. In other embodiment, the lead and the ceramic package may be bonded by means of so-called silver brazing. For example, a silver brazing member as the connecting material is placed on the ceramic package, and the lead is placed on the silver brazing member so that the silver brazing member is located between the lead and the ceramic package, followed by melting the silver brazing member so that the lead and the ceramic package can be welded together. As the silver brazing member, a member may be exemplified which is made of an Au—Cu alloy, an Ag—Cu—Ti or Kovar (iron-nickel-cobalt alloy), and it is preferably in the form which surrounds the opening of the ceramic package (for example, a ring (circular annular) shape, a rectangular annular shape or the like). By heating the connecting material such as a solder material or a silver brazing member which is located between the lead and the ceramic package (while applying a force when required) so that the connecting material is melted, whereby a connecting member can be formed which bonds the lead to the ceramic package.

The ceramic package preferably has a metal layer surrounding the opening, and the periphery of the lead is preferably positioned on this metal layer when the lead is disposed such that it closed the opening of the open-ended space. It is particularly preferable that such metal layer is tightly bonded to a periphery of a surface which defines the opening of the ceramic package. In order to ensure such tightly bonding, a metal layer may be formed on such periphery of the ceramic package by means of sintering, plating or the like.

In the state wherein the lead is positioned on the metal layer as described above, the lead and the metal layer are connected together. For the connection, a connecting material such as a solder material, an electrically conductive adhesive, an electrically conductive paste, and the like, preferably a solder material, is disposed on the metal layer and the lead placed thereon, after which they may be connected integrally by forming a connecting member by for example heating with a heating means or putting in a reflow oven so as to melt the connecting material, so that the open-ended space of the ceramic package is closed.

In another embodiment, the lead and the ceramic package may be connected by welding together with the lead positioned directly on the metal layer provided on the ceramic package (i.e. without providing a connecting material as described above) to form a connecting member. In this embodiment, a welded portion which is formed by welding the metal layer and the lead at their interface functions as a connecting member. For the purpose of such welding, for example a resistance welding (such as seam welding), laser welding and the like may be used.

In the case wherein the connecting material is present between the lead and the metal layer of the ceramic package (i.e. the case of indirectly connecting by using a connecting material such as a solder material, a silver brazing member or the like) or in the case wherein the lead and metal layer of the ceramic package are directly in contact (i.e. the case of directly connecting by welding), bonding of the lead to the ceramic package becomes surer, so that the encapsulation of the PTC component within the ceramic package becomes surer. Such metal layer may be made of any appropriate material, and as such material, for example, a molybdenum/manganese alloy, a tungsten layer, and an Ag—Cu—Ti and the like may be exemplified. For example, paste of a metal which is to form the metal layer is applied, followed by sintering the paste, so that a metal layer is obtained which is tightly bonded to the ceramic package.

In the embodiment wherein the ceramic package includes the metal layer, when the lead is indirectly connected to the metal layer via the connecting material such as the solder material, a silver brazing member or the like or when the metal layer and the lead are directly connected by welding them, the metal layer may have another metal layer thereon which facilitates the bonding between them. Said another metal layer may be formed by for example plating, vapor deposition or the like. Specifically, for example a plated nickel layer, a plated zinc layer or the like as said another metal layer may be formed on a molybdenum/manganese alloy layer, a tungsten layer or the like as the metal layer. Further, a gold flash plating may be carried out as to said another metal layer.

Figure 2:
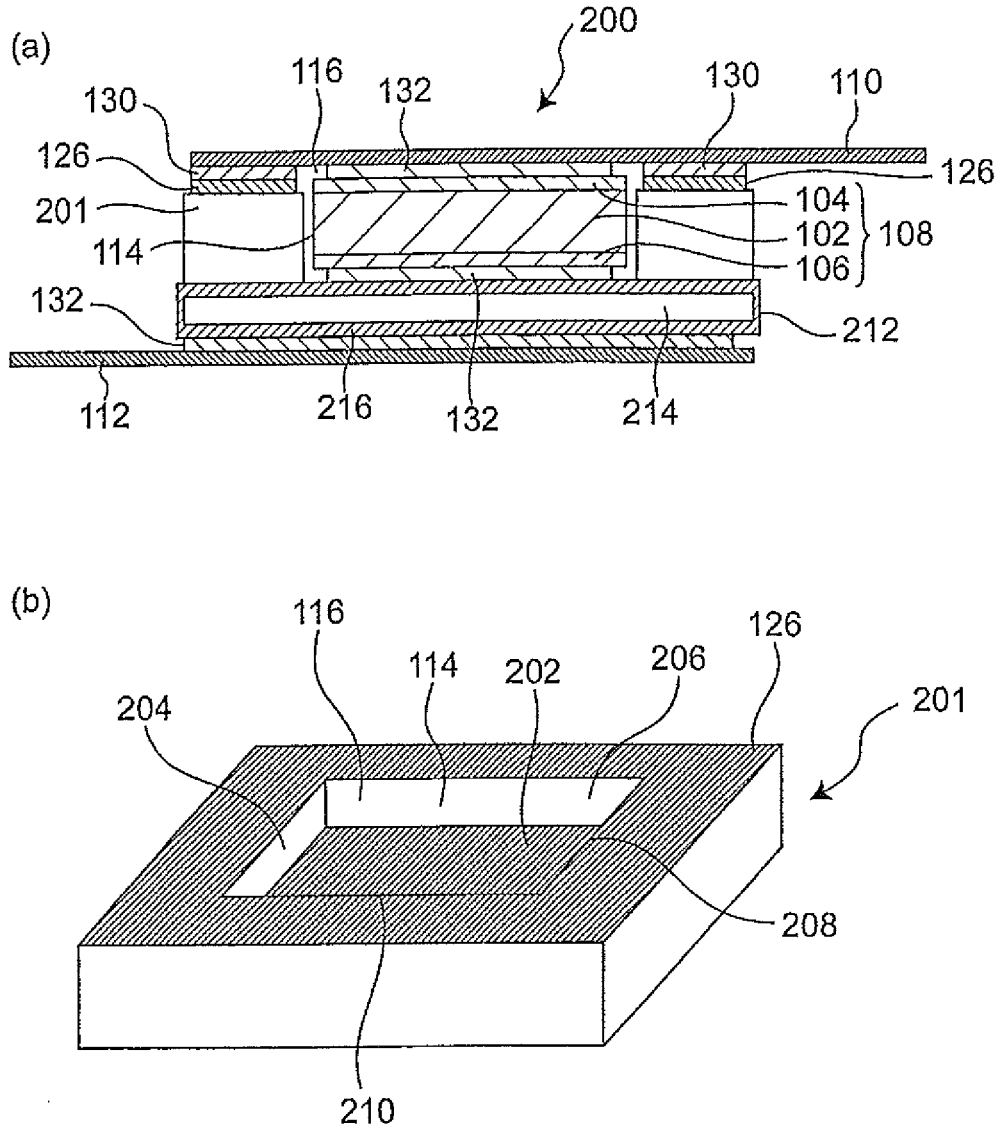
FIG. 2 (*a*) shows schematically a cross-sectional side view of another embodiment of the PTC device of the present invention, and FIG. 2 (*b*) shows schematically a perspective view of the ceramic package used in the PTC device of FIG. 2 (*a*)
Figure 3:
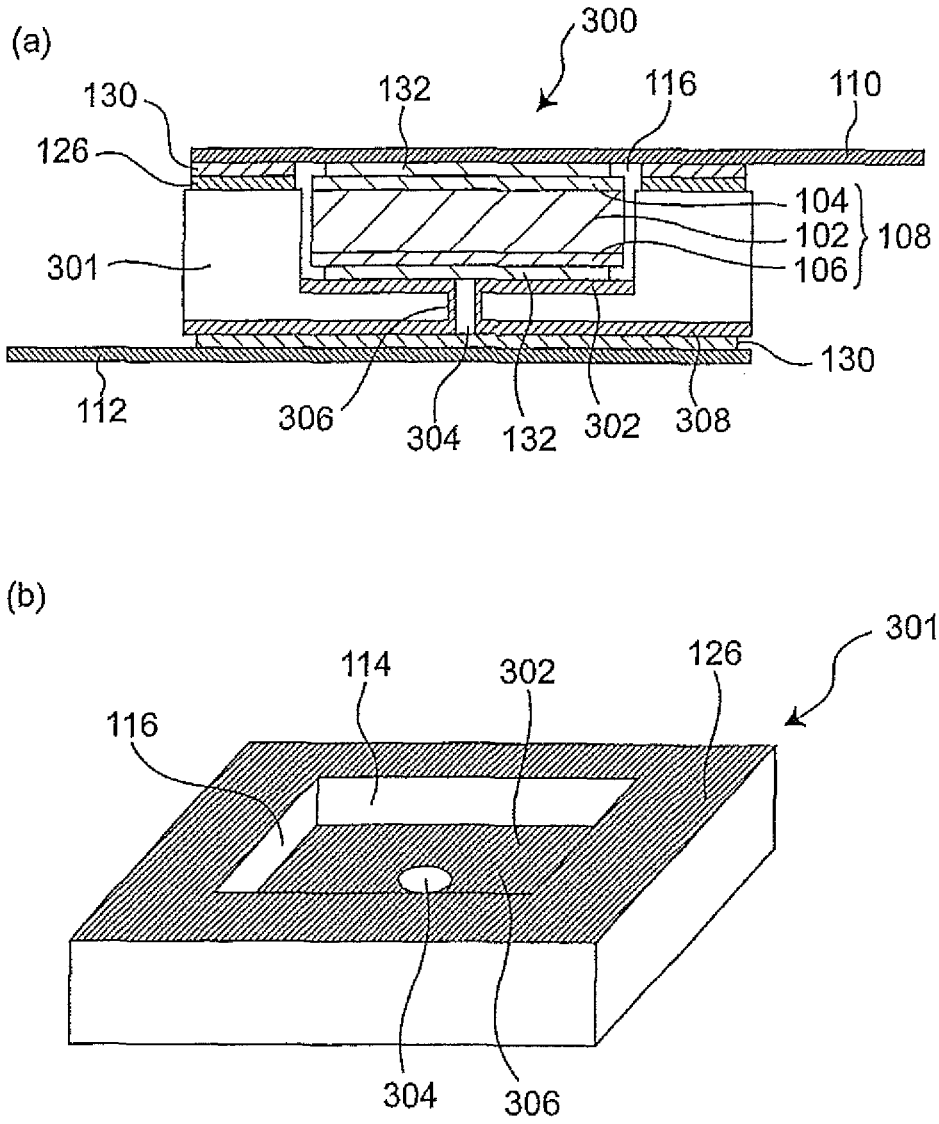
FIG. 3 (*a*) shows schematically a cross-sectional side view of a further embodiment of the PTC device of the present invention, and FIG. 3 (*b*) shows schematically a perspective view of the ceramic package used in the PTC device of FIG. 3 (*a*)

Next, the PTC device of the present invention is described in more detail with reference to the drawings. FIG. 1 (*a*) shows one embodiment of the PTC device of the present invention as a schematic cross-sectional side view. Further, FIG. 1 (*b*) is a schematic perspective view of the ceramic package used in the device shown in FIG. 1 (*a*). In FIG. 2 and FIG. 3 as well, (a) and (b) are drawings similar to FIG. 1 (*a*) and FIG. 1 (*b*). In the drawings the same reference numbers denote elements having substantially the same functions.

The PTC device 100 in the embodiment shown in FIG. 1 comprises:

(1) a polymer PTC component 108 comprising a laminar polymer PTC element 102, and a first metal electrode 104 and a second metal electrode 106 disposed on the main surfaces on both sides thereof;

(2) a first lead 110 and a second lead 112 connected to both metal electrodes of the polymer PTC component; and (3) a ceramic package 120 having an open-ended space 114 for accommodating the polymer PTC component, said open-ended space having two openings 116 and 118 that define the open-ended space, said leads 110 and 112 closing said openings 116 and 118 (therefore, two openings) in order to isolate the polymer PTC component 108 disposed in said open-ended space 114 from the environment surrounding the ceramic package 120.

As shown in FIG. 1 (*b*), the facing main surfaces 122 and 124 of the ceramic package have openings 116 and 118 respectively, by which the open-ended space 114 becomes a feed-through opening with both ends opened. Further, a metal layer 126 is disposed with respect to the opening on the main surface and this surrounds the opening (although in FIG. 1 (*b*) only the upper side metal layer 126 is shown, the ceramic package has a metal layer 128 on the lower side as well as shown in FIG. 1 (*a*)). Such a metal layer is provided on the ceramic package used for semiconductor chips, and the like, for various purposes. For example, it is provided to secure electrical connection between the interior and the exterior of the pack. In the PTC device of the present invention, the metal layer of the ceramic package is used as the object to which to the lead is connected.

Specifically, connecting members 130 are present between these metal layers (126 and 128) and their respective leads (110 and 112) by which the leads and the metal layers, and thus the leads and the ceramic package, are bonded. Since, as described above, the metal layers are present such that they surrounds the openings of the open-ended space respectively, if the leads are placed on the main surfaces of the ceramic package so that they are placed on the peripheries of the openings and the metal layers and the leads are bonded around the openings, the open-ended space of the ceramic package is closed and sealed by the leads.

When the lead and metal layer are bonded in this way at the openings on each of the main surfaces of the ceramic package, the PTC component 108 disposed within the space 114 is substantially isolated from the exterior of the ceramic package, so that the influence of the atmosphere surrounding the ceramic package, i.e. the influence of air (or oxygen), can be minimized, as a result of which the oxidation of the electrically conductive filler contained in the PTC element can be inhibited to the extent possible.

In the illustrated embodiment, the connections between the metal electrodes 104 and 106 of the PTC component and the leads 116 and 112 are electrically connected, which is secured by the connecting member 132 disposed between them which is formed of an electrically conductive connecting material such as solder. In another embodiment, an electrically conductive adhesive or an electrically conductive paste may be used for the connections between them.

The PTC device shown in FIG. 1 (*a*) may be produced by for example the following process wherein first:

placing a solder material as a connecting material (corresponding to a precursor of the connecting members 132 and 130) on the second lead 112, placing a PTC component 108 on such solder material such that the second lead 112 and the second metal electrode 106 of the PTC component are facing to each other, and placing the metal layer 128 of the ceramic package 120 such that the second lead 112 closes the lower side opening 118 of the ceramic package 120.

That is, in order that the solder material (corresponding to the connecting member 132) is located between the second lead 112 and the second metal electrode 106, and the solder material (corresponding to the connecting member 130) is located between the second lead 112 and the metal layer 128 on the periphery of the lower side opening of the ceramic package, these are located.

Next, a solder material (corresponding to a precursor of the connecting members 132 and 130) is placed on the first metal electrode 104 and the metal layer 126, and the first lead 110 is placed on the metal layer 126 of the ceramic package such that the first lead 110 and the first metal electrode 104 of the PTC component oppose to each other through such solder material and also the first lead 110 closes the upper opening 116 of the ceramic package. That is, in order that the solder material (corresponding to the connecting member 132) is located between the first lead 110 and the first metal electrode 104, and the solder material (corresponding to the connecting member 130) is located between the first lead 110 and the metal layer 126 on the periphery of the upper side opening of the ceramic package, these are located.

The thus formed assembly is obtained which composed of the first lead, the second lead, the ceramic package, the PTC component and the solder material located between them, and such assembly is put into a heating furnace (or a reflow oven) so as to melt the solder material followed by cooling thereof so as to convert the solder material to the connecting member, whereby the device as shown in FIG. 1 is obtained.

FIG. 2 shows, similarly to FIG. 1, another embodiment of the PTC device according to the present invention. The PTC device 200 of the embodiment shown in FIG. 2 has a polymer PTC component 108 similar to that of FIG. 1, and also has a first lead 110 electrically connected to one of the metal electrodes 104 acting as the first metal electrode by means of a connecting member 132 and also connected to the metal layer 126 of the ceramic package by means of a connecting member 130. This PTC component 108 is disposed in the ceramic package 201 shown in FIG. 2 (*b*).

As shown in FIG. 2 (*b*), the ceramic package 201 has an open-ended space 114 for accommodating the polymer PTC component; in the illustrated embodiment, said open-ended space is defined by a bottom 202 and four walls 204, 206, 208, and 210 positioned so as to surround the bottom, and has an opening 116 that opens on one of the main surfaces of the ceramic package. In other words, the package is a housing having the bottom, and the open-ended space has one opening 116.

As with the embodiment shown in FIG. 1, the ceramic package has a metal layer 126 surrounding the opening 116, and further has an electrical conductor 212 (this may be in any appropriate form, for example a metal layer, a metal wire, or a metal strip, etc.) to secure electrical conductance between the inner side (the upper side) and the outer side (the lower side) of the bottom defining the space. In the illustrated embodiment, the electrical conductor is in the form of a metal layer that substantially covers the entire upper exposed surface of the bottom 202, extends from the exposed surface of the bottom to the sides of the ceramic package, then wraps around from the sides to the lower surface of the bottom as shown in FIG. 2 (*b*) (it is noted that in FIG. 2(*b*), only the exposed portion of the metal layer positioned on the bottom is shown). Therefore, as can be understood from FIG. 2(*a*), the electrical conductor 212 is present so as to surround a member 214 defining the bottom of the ceramic package. It is noted that the first lead is substantially the same as that in FIG. 1.

As shown in FIG. 2(*a*), a portion 216 of the above-described electrical conductor 212 which portion is positioned on the outer side of the bottom defining the space, (that is, a portion 216 which is located under the member 214 defining the bottom) and the second lead 112 are connected electrically. The connection between the second lead 112 and the electrical conductor 212, particularly the portion 216 of the electrical conductor 212 may be similar to the connection between the first lead 110 and the metal layer 126, and may be implemented by forming a connecting member 130 with a connecting material such as a solder, an electrically conductive adhesive, an electrically conductive paste, etc. Such an electrical conductor 212 is electrically connected to the other metal electrode 106 as the second electrode of the polymer PTC component by means of the connecting member 132.

Thus, in contrast to the PTC device shown in FIG. 1, where the second metal electrode 106 and the second lead 112 are directly connected, the second metal electrode 106 of the PTC component is connected indirectly to the second lead 112 via the electrical conductor 212 in the PTC device in the embodiment shown in FIG. 2.

The embodiment shown in FIG. 2 is convenient in that encapsulation of the PTC component 108 in the ceramic package is completed by merely installing the first lead 110 to the ceramic package (which is already accommodating the PTC component), more specifically to its metal layer 126. For example, the PTC device of the present invention shown in FIG. 2 may be produced by the following process wherein an assembly is placed in a heating oven to melt a solder material, then followed by cooling, which assembly is formed by placing the ceramic package 201 on the second lead 112 through a connecting material such as solder (which corresponds to a precursor of the connecting member 130), next placing a solder material (which corresponds to a precursor of the connecting member 132) on the exposed upper side of the bottom of the ceramic package, placing the PTC component 108 thereon, next placing solder material (corresponding to a precursor of the connecting members 130 and 132) on the first electrode 104 of the PTC component and the metal layer 126 of the ceramic package, and placing the first lead 110 thereon.

Thus, the PTC device shown in FIG. 2 (*a*) may be made by placing an assembly in a heating furnace (for example a reflow oven) to melt solder materials followed by cooling, which assembly is obtained by placing the solder material (which corresponds to a precursor of the connecting member 130) as the connecting material on the second lead 112 the obtaining a construction (or assembly), placing the ceramic package 120 on the solder material, placing the PTC component 108 on the bottom 202 of the ceramic package via a solder material as the connecting material, then placing the solder material (which corresponds to precursors of the connecting members 132 and 130) on the first metal electrode 104 of the PTC component and the metal layer 126 of the ceramic package, and placing the first lead 110 on the solder material so as to close the opening 116.

FIG. 3 shows, similarly to FIG. 1, a further embodiment of the PTC device of the present invention. The PTC device 300 of the embodiment shown in FIG. 3 has a polymer PTC component 108 similar to that of FIG. 1, and also has a first lead 110 connected to one of the metal electrodes 104 of the polymer PTC component 108 acting as the first metal electrode by means of the connecting member 132. This PTC component 108 is disposed in the ceramic package 301 shown in FIG. 3 (*b*). As readily seen, the connection between the first lead and the first metal electrode and the ceramic package in FIG. 3 is similar to that of the embodiment shown in FIG. 1 or FIG. 2.

The ceramic package 301 has a metal layer 126 surrounding the opening 116; also, as shown in FIG. 3(*b*) it differs from the ceramic package shown in FIG. 2(*b*) in that the bottom 302 that defines the open-ended space 114 accommodating the polymer PTC component has a throughhole 304. As a result, as shown in FIG. 3(*a*), an electrical conductor 306 is provided via the inner wall of the throughhole 304 in order to secure electrical conductance between the inner side (upper side) and the outer side (lower side) of the bottom that defines the space.

As shown in FIG. 3(*a*), the portion of the above-described electrical conductor 306 that is positioned on the outer side (lower side) of the bottom defining the space and the second lead 112 are connected electrically. The connection between the second lead 112 and a portion 308 of the electrical conductor 306 may be similar to the connection between the first lead 110 and the metal layer 126, and may be implemented with, for example, a solder, an electrically conductive adhesive, an electrically conductive paste, etc.

Thus, in contrast to the PTC device shown in FIG. 1, where the second metal electrode 106 and the second lead 112 are directly connected, the second metal electrode 106 of the PTC component is connected indirectly to the second lead 112 via the electrical conductor 306 in the PTC device in the embodiment shown in FIG. 3 as in FIG. 2. In this embodiment, because electrical conductance between the inner side and the outer side of the ceramic package may be secured without going through the side of the ceramic package, the manufacture of the ceramic package is easy. For example, the electrical conductor 306 may be formed by disposing an electrical conductor portions (for example, metal layer, metal wire, metal strip, etc.) on the inside and outside of the bottom of the ceramic package and extending to the periphery of the throughhole 304 and connecting the inner and outer electrical conductor portions by metal plating the inner wall of the throughhole.

Although the PTC device shown in FIG. 3(*a*) differs in that it has the throughhole 304, regarding the formation of the assembly, the assembly may be formed substantially in the same way as previously described with respect to the PTC device in FIG. 2(*a*). Therefore, the manufacture of the PTC device in FIG. 3(*a*) is the same as in FIG. 2(*a*).

Figure 4:
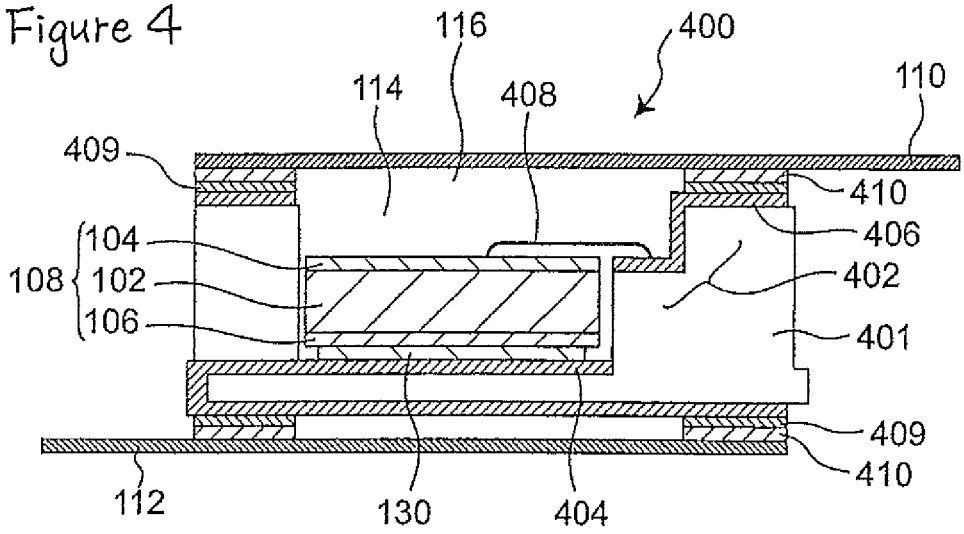
FIG. 4 shows schematically a cross-sectional side view of a yet further embodiment of the PTC device of the present invention.

FIG. 4 shows a further embodiment of the PTC device of the present invention. The PTC device 400 of the embodiment shown in FIG. 4 has a polymer PTC component 108 similar to that of FIG. 1, and also has a first lead 110 connected to one of the metal electrodes 104 acting as the first metal electrode of the polymer PTC component 108. This PTC component 108 is disposed in a ceramic package 401, which is similar to the ceramic package shown in FIG. 2(*b*) but differs in that the bottom has a step section 402.

In this ceramic package 400, the bottom has the step section 402 [see Comment 8], and two independent electrical conductors 404 and 406 (for example metal layers, metal wires, metal strips, etc.) are provided on both sides of the step section. One of the electrical conductors 404 is, similarly to that of FIG. 2, is positioned on the bottom and is connected to the second metal electrode 106 of the PTC component and at the same time electrically connected to the second lead 112 positioned on the exterior (or lower side) the bottom. The other electrical conductor 406 is electrically connected to the first lead 110 and at the same time electrically connected to the first metal electrode 104 of the PTC component by wire bonding 408. Therefore, in the embodiment of FIG. 4, the metal electrodes of the PTC component are each indirectly connected to leads.

In the embodiment of FIG. 4, the first lead 110 and the second lead 112 are connected directly to the metal layer acting as the electrical conductor 406 of the ceramic conductor and the electrical conductor 404 respectively, and as a result, are connected indirectly to the metal electrodes of the PTC component. Therefore, the connection of the leads to the metal layer or the electrical conductor may also be performed through a connection method having more stringent thermal conditions.

Thus, the PTC device shown in FIG. 4 may be produced by the following process: wherein the ceramic package is placed first such that another metal layer 409 is positioned on the second lead 112, followed by welding them together to form a welded section 410, then a solder material (which corresponds to the connecting material) is placed on the upper side of the bottom of the ceramic package, followed by placing the PTC component 108 thereon, and then heating to connect the second metal electrode 106 of the PTC component to the metal layer 404, then the first electrode 104 of the PTC component and the metal layer 402 are connected by wired bonding, and then the first lead 110 is placed on the metal layer 406 on the periphery of the ceramic package through another metal layer 409 in such a way as to close the opening 116 of the ceramic package, followed by welding the first lead 110 to said another metal layer 409 to form a welded section 410. It is noted that said another metal layer is preferably bonded to the metal layer of the ceramic package beforehand by for example plating, sintering or the like.

Since the metal electrode is generally thin (normally in the form of a metal foil), a method wherein solder, conductive adhesive, conductive paste, and the like, is heated in a heating oven is generally used in the case of directly connecting the lead to the metal electrode. In contrast, when directly connecting the lead to the metal layer or the electrical conductor, they can be connected by welding so that a more reliable connection may be secured between them. In other words, a more reliable encapsulation of the PTC component in the ceramic package may be achieved.

In FIG. 4, the ceramic package 401 has a metal layer 406 on the upper main surface beforehand and further has another metal layer (for example an Au—Cu layer, a Kovar layer) 409 to facilitate welding. It is noted that in the illustrated embodiment, the welded section 410 is also shown. As to the lower metal layer 404, it similarly has another metal layer 409, and the welded portion 410 is also shown.

In the various embodiments described above, if the step of closing the opening of the ceramic package with the lead is performed under an inert gas atmosphere, for example under a nitrogen atmosphere or under a vacuum, the space in which the PTC component is held is closed by the lead while filled with the inert gas, so the oxidation problem of the metal filler contained in the PTC element is further alleviated.

EXAMPLES

The PTC device of the present invention shown in FIG. 4 was simulated using the following ceramic package, PTC component, and lead:

Ceramic package (manufactured by NGK Spark Plug Co., Ltd., made of aluminum oxide)

Size (outer dimensions): 4.8 mm×9.1 mm×1.3 mm (height)

Size of open-ended space: 3.4 mm×7.7 mm×1.05 mm (height)

Metal layer: Ni plating and then Au plating on Mo/Mn layer (corresponding to 404 and 406 in FIG. 4); Plated layer corresponds to 409 in FIG. 4.

PTC component (manufactured by Tyco Electronics Raychem, product name: PolySwitch)

Size: 2.3 mm×3.0 mm×0.43 mm (thickness)

Lead (made of nickel, size: 5 mm×20 mm×0.125 mm (thickness))

After disposing the PTC component within the open-ended space in the ceramic package, a lead was placed on the ceramic package, the opening defining said space was closed by welding the lead and the metal layer (406+409) on the periphery of the ceramic package to encapsulate the PTC component in the ceramic package.

Next the ceramic package obtained was held under an air atmosphere of 40 atmospheres, then the lead was peeled off the ceramic package and the PTC component taken out. After measuring the resistance (R1) of the PTC component thus taken out, it was tripped under an application condition of 6V/50A and held for 5 minutes; then the application was stopped and the resistance (R2) of the PTC component was measured after one hour. As comparative examples, the resistance of a PTC component held in a ceramic package under the same condition but without encapsulating with the lead was similarly measured. The results are shown in Table 1 and Table 2.

TABLE 1

Examples of the present invention (unit: mΩ)

| | R1 (Resistance before trip) | R2 (Resistance after trip) |
|---|---|---|
| 1 | 6.3 | 8.0 |
| 2 | 7.8 | 9.8 |
| 3 | 9.3 | 11.1 |
| 4 | 7.2 | 9.6 |
| 5 | 7.9 | 10.3 |
| 6 | 8.3 | 10.9 |
| 7 | 6.5 | 8.8 |
| 8 | 10.3 | 12.4 |
| 9 | 8.0 | 9.5 |
| 10 | 6.8 | 8.8 |
| 11 | 7.4 | 10.2 |
| 12 | 7.7 | 9.9 |
| 13 | 7.5 | 9.9 |
| 14 | 6.8 | 9.0 |
| 15 | 7.1 | 9.0 |
| 16 | 8.0 | 9.9 |
| 17 | 7.4 | 10.0 |
| 18 | 6.9 | 8.5 |
| Average | 7.6 | 9.8 |
| Minimum Value | 6.3 | 8.01 |
| Maximum Value | 10.3 | 12.4 |
| Standard Deviation | 0.95 | 1.01 |

TABLE 2

Comparative Examples (unit: mΩ)

| | R1 (Resistance before trip) | R2 (Resistance after trip) |
|---|---|---|
| 1 | 6.2 | 64.0 |
| 2 | 5.7 | 57.1 |
| 3 | 6.0 | 54.2 |
| 4 | 7.3 | 56.0 |
| 5 | 7.2 | 80.2 |
| 6 | 6.7 | 97.0 |
| 7 | 6.8 | 70.1 |
| 8 | 7.5 | 59.0 |
| 9 | 6.7 | 71.8 |
| 10 | 7.8 | 69.6 |
| Average | 6.8 | 67.9 |
| Minimum Value | 5.7 | 54.2 |
| Maximum Value | 7.8 | 97.0 |
| Standard Deviation | 0.64 | 12.50 |

In the present examples of the present invention, no electrical connection is implemented between the lead and the metal electrode of the PTC component. The effect of suppressing the oxidation of the metal filler of the PTC element by encapsulating the PTC component in the ceramic package using the lead is evident by comparing the results of Table 1 and Table 2 without implementing such an electrical connection. It is in this sense that it was stated "the PTC device of the present invention shown in FIG. 4 was simulated".

In particular, in the PTC device of the present invention, increase in resistance after the PTC component is tripped can be suppressed. This effectively prevents oxidation of the conductive filler so that the reliability of the PTC component, and thus the PTC device, is maintained over the long term, as a result of which the reliability and safety of the apparatus and the like using the PTC device may be improved.

As the present invention can suppress the oxidation of the metal filler contained in the PTC element of the PTC component constituting the PTC device, it can alleviate the problem of the resistance of the PTC component increasing over time.

It is noted that the application claims a priority based on Japanese patent application No. 2008-148888 (filed on Jun. 6, 2008, the title of the invention is "PTC device"), and such application is incorporated herein by reference in their entirety.

EXPLANATION OF THE FIGURE ELEMENTS

100—PTC device; 102—PTC element;
104—first metal electrode; 106—second metal electrode;
108—PTC component; 110—first lead; 112—second lead;
114—open-ended space; 116, 118—opening;
120—ceramic package; 122, 124—main surface;
126, 128—metal layer; 130, 132—connecting member;
200—PTC device; 201—ceramic package; 202—bottom;
204, 206, 208, 210—wall defining the space;
212—electrical conductor; 300—PTC device;
301—ceramic package; 302—bottom; 304—throughhole;
306—electrical conductor; 400—PTC device;
401—ceramic package; 402—step section;
404, 406—electrical conductor; 408—bonding wire;
409—another metal layer; 410—welded section

What is claimed is:

1. A PTC device comprising:

(1) a polymer PTC component comprising a polymer PTC element and a first and a second metal electrode disposed on both sides of the main surface thereof;

(2) a lead connected to at least one of the metal electrodes of the polymer PTC component; and (3) a ceramic package having an open-ended space for accommodating the polymer PTC component, said open-ended space having at least one opening that defines the open-ended space, the PTC device being characterized by (a) said lead which closes said opening in order to isolate the polymer PTC component disposed in said open-ended space from the environment surrounding the ceramic package, (b) the ceramic package being a housing with a bottom which has an opening on one of the main surfaces thereof and further has an electrical conductor connecting an outer side and an inner side defining the bottom of said housing with the bottom, wherein the lead as a first lead connected to the first metal electrode of the polymer PTC component closes the opening of the ceramic package, and the second metal electrode of the PTC component is connected to said electrical conductor at the bottom of the ceramic package, so that the second metal electrode is connected to a second lead connected to said electrical conductor, and (c) the ceramic package having a feed-through hole across the bottom and an electrical conductor connecting the inner side and the outer side of the bottom via the feed-through hole, wherein the second lead disposed on the outer side of said bottom is connected to said electrical conductor while at the same time closes said feed-through hole.

2. A PTC device comprising:

(1) a polymer PTC component comprising a polymer PTC element and a first and a second metal electrode disposed on both sides of the main surface thereof;

(2) a lead connected to at least one of the metal electrodes of the polymer PTC component; and (3) a ceramic package having an open-ended space for accommodating the polymer PTC component, said open-ended space having at least one opening that defines the open-ended space, the PTC device being characterized by (a) said lead which closes said opening in order to isolate the polymer PTC component is disposed in said open-ended space from the environment surrounding the ceramic package, and (b) the ceramic package having on its main surface a metal layer surrounding the opening, wherein the at least one lead closing the opening is disposed on the metal layer on the main surface of the ceramic package, and is connected to the ceramic package by a connecting member located between said lead and the metal layer.

3. The PTC device according to claim 2, characterized by the connecting member being formed of a solder.

4. The PTC device according to claim 2, characterized by the connecting member being a welded part of the lead and the metal layer located therebetween.

5. The PTC device according to claim 1, characterized by the first metal electrode of the PTC component being connected to the lead or the first lead.

6. The PTC device according to claim 2, characterized by the metal layer surrounding the opening of the ceramic package having a section extending within the open-ended space, wherein the first metal electrode of the PTC component is connected to said section thereby being connected to said lead.

7. The PTC device according to claim 1, characterized by the PTC component being encapsulated in the open-ended space in a nitrogen atmosphere or a vacuum.

8. A PTC device comprising:

(1) a polymer PTC component comprising a polymer PTC element and a first and a second metal electrode disposed on both sides of the main surface thereof;

(2) a lead connected to at least one of the metal electrodes of the polymer PTC component; and (3) a ceramic package having an open-ended space for accommodating the polymer PTC component, said open-ended space having at least one opening that defines the open-ended space, the PTC device being characterized by (a) said lead which closes said opening in order to isolate the polymer PTC component is disposed in said open-ended space from the environment surrounding the ceramic package, (b) said open-ended space being a feed-through space which has a first opening and a second opening located on a first main surface and a second main surface which are facing to each other, wherein a first lead connected to one of the metal electrodes of the polymer PTC component closes the first opening and a second lead connected to the other metal electrode of the polymer PTC component closes the second opening, and (c) the ceramic package having on its main surface a metal layer surrounding the opening, wherein the at least one lead closing the opening is disposed on the metal layer on the main surface of the ceramic package, and is connected to the ceramic package by a connecting member located between said lead and the metal layer.

9. A PTC device comprising:

(1) a polymer PTC component comprising a polymer PTC element and a first and a second metal electrode disposed on both sides of the main surface thereof;

(2) a lead connected to at least one of the metal electrodes of the polymer PTC component; and (3) a ceramic package having an open-ended space for accommodating the polymer PTC component, said open-ended space having at least one opening that defines the open-ended space, the PTC device being characterized by (a) said lead which closes said opening in order to isolate the polymer PTC component disposed in said open-ended space from the environment surrounding the ceramic package, (b) the ceramic package being a housing with a bottom which has an opening on one of the main surfaces thereof and further has an electrical conductor connecting an outer side and an inner side defining the bottom of said housing with the bottom, wherein the lead as a first lead connected to the first metal electrode of the polymer PTC component closes the opening of the ceramic package, and the second metal electrode of the PTC component is connected to said electrical conductor at the bottom of the ceramic package, so that the second metal electrode is connected to a second lead connected to said electrical conductor, and (c) the ceramic package having on its main surface a metal layer surrounding the opening, wherein the at least one lead closing the opening is disposed on the metal layer on the main surface of the ceramic package, and is connected to the ceramic package by a connecting member located between said lead and the metal layer.

10. The PTC device according to claim 1, characterized by the ceramic package having on its main surface a metal layer surrounding the opening, wherein the at least one lead closing the opening is disposed on the metal layer on the main surface of the ceramic package, and is connected to the ceramic package by a connecting member located between said lead and the metal layer.

11. The PTC device according to claim 2, characterized by the first metal electrode of the PTC component being connected to the lead or the first lead.

12. The PTC device according to claim 3, characterized by the first metal electrode of the PTC component being connected to the lead or the first lead.

13. An electrical apparatus comprising a PTC device, said PTC device comprising:

(1) a polymer PTC component comprising a polymer PTC element and a first and a second metal electrode disposed on both sides of the main surface thereof;

(2) a lead connected to at least one of the metal electrodes of the polymer PTC component; and (3) a ceramic package having an open-ended space for accommodating the polymer PTC component, said open-ended space having at least one opening that defines the open-ended space, the PTC device being characterized by (a) said lead which closes said opening in order to isolate the polymer PTC component is disposed in said open-ended space from the environment surrounding the ceramic package, and (b) the ceramic package having on its main surface a metal layer surrounding the opening, wherein the at least one lead closing the opening is disposed on the metal layer on the main surface of the ceramic package, and is connected to the ceramic package by a connecting member located between said lead and the metal layer.

14. The electrical apparatus of claim 13, characterized by the first metal electrode of the PTC component being connected to the lead or the first lead.

15. The electrical apparatus of claim 13, characterized by the PTC component being encapsulated in the open-ended space in a nitrogen atmosphere or a vacuum.

* * * * *